US007417615B2

(12) United States Patent
Senda

(10) Patent No.: US 7,417,615 B2
(45) Date of Patent: Aug. 26, 2008

(54) ACTIVE MATRIX LIQUID CRYSTAL DISPLAY DEVICE

(75) Inventor: Michiru Senda, Gifu (JP)

(73) Assignee: Sanyo Electric Co., Ltd., Osaka (JP)

( * ) Notice: Subject to any disclaimer, the term of this patent is extended or adjusted under 35 U.S.C. 154(b) by 790 days.

(21) Appl. No.: 11/069,060

(22) Filed: Mar. 2, 2005

(65) Prior Publication Data

US 2005/0195146 A1 Sep. 8, 2005

(30) Foreign Application Priority Data

Mar. 4, 2004 (JP) ..... 2004-060783

(51) Int. Cl.
*G09G 3/36* (2006.01)

(52) U.S. Cl. ..... 345/96; 345/94; 345/209

(58) Field of Classification Search ..... 345/94, 345/96, 209

See application file for complete search history.

(56) References Cited

U.S. PATENT DOCUMENTS 6,115,018 A * 9/2000 Okumura et al. ..... 345/95
6,552,706 B1 * 4/2003 Ikeda et al. ..... 345/96
6,897,845 B2 * 5/2005 Ozawa ..... 345/94
7,088,328 B2 * 8/2006 Inada et al. ..... 345/96
7,205,969 B2 * 4/2007 Song ..... 345/87

FOREIGN PATENT DOCUMENTS

JP 2000-081606 3/2000
JP 2003-150127 5/2003

* cited by examiner

*Primary Examiner*—Kent Chang
(74) *Attorney, Agent, or Firm*—Morrison & Foerster LLP

(57) ABSTRACT

The non-linear amplifier performs a gamma correction to the analog video signal inputted from outside along with the non-linear correction for eliminating the effect of the dependency of the dielectric constant of the liquid crystal on the pixel potential Vp. The analog video signal corrected by the non-linear amplifier is then applied to a pair of amplifiers and that output a pair of signals with the polarity inverted against the potential Vcom of the common electrode. A switching circuit switches and outputs the output from the pair of the amplifiers according to the inverted signal.

9 Claims, 11 Drawing Sheets

ACTIVE MATRIX LIQUID CRYSTAL DISPLAY DEVICE

CROSS-REFERENCE OF THE INVENTION

This invention is based on Japanese Patent Application No. 2004-060783, the content of which is incorporated herein by reference in its entirety.

BACKGROUND OF THE INVENTION

1. Field of Invention

This invention relates to an active matrix display device.

2. Description of Related Art

The deterioration of liquid crystal is prevented by the common AC driving that gives AC potential to a common electrode and a supplemental capacitance. Low energy consumption is achieved by lowering both electric current and voltage of a drain driver through the minimization of the potential difference between the positive and negative polarities of the video signal inputted to the drain driver in the active matrix display device, in which a video signal is supplied to an independent pixel electrode through a switching element such as a thin film transistor (TFT).

However, the load and the energy consumption of the capacitance in the common electrode and all the supplemental capacitance lines are still large because the voltage polarity of the common electrode and the supplemental capacitance lines are inverted at each horizontal period with the horizontal inversion common AC driving that inverts the polarity of the video signal given to the drain line at each horizontal period.

Japanese Patent Application Publication No. Hei 12-81606 discloses a driving method that can significantly lower the energy consumption by stabilizing the common electrode voltage and by inverting the polarity of the supplemental capacitance voltage and that can simultaneously lower both electric current and voltage of the drain driver through minimization of the potential difference between the positive and negative polarities of the video signal (referred to as "SC driving", hereinafter).

Also, Japanese Patent Application Publication No. 2003-150127 discloses the dot inversion driving system, in which the voltage with opposite polarity is applied to the pixels in such way that any pair of the adjacent pixels have opposite polarity from each other by supplying the voltage with opposite polarity to the pixel electrodes next to each other in gate line direction, as shown in FIG. 11. The dot inversion driving system can prevent capacitance coupling and the irregularity of the image due to the capacitance coupling that takes place in the SC driving.

However, the dielectric constant of liquid crystal changes according to the change in an applied voltage in the SC driving and the dot inversion driving. Therefore, the potential of the pixel electrode depends on the liquid crystal capacitance and changes non-linearly against the inputted video signal. The potential of the pixel electrode adequate for the inputted video signal voltage cannot be obtained, leading to the deterioration of the gradation characteristics.

SUMMARY OF THE INVENTION

The invention provides an active matrix display device comprising, a plurality of pixel electrodes disposed on a substrate in a matrix configuration, a liquid crystal sealed between the pixel electrodes and a common electrode, a plurality of switching elements connected to corresponding pixel electrodes, a first supplemental capacitance line supplied with a first potential, and a second supplemental capacitance line supplied with a second potential. The first and second potentials alternate with a first cycle. The display device also includes a supplemental capacitance electrode provided for each of the pixel electrodes so that each supplemental capacitance electrode forms a capacitance between said each supplemental capacitance electrode and the first supplemental capacitance line or the second supplemental capacitance line, a driver circuit supplying to the pixel electrodes and the supplemental capacitance electrodes through the switching elements a first video signal and a second video signal that are opposite in polarity and alternate in a second cycle, and a correction circuit correcting the first and second video signals so as to reduce an effect of dielectric constant of the liquid crystal that changes in response to a change in a potential applied to the liquid crystal on potentials of the pixel electrodes receiving the first video signal or the second vide signal.

DETAILED DESCRIPTION OF THE INVENTION

Figure 1:
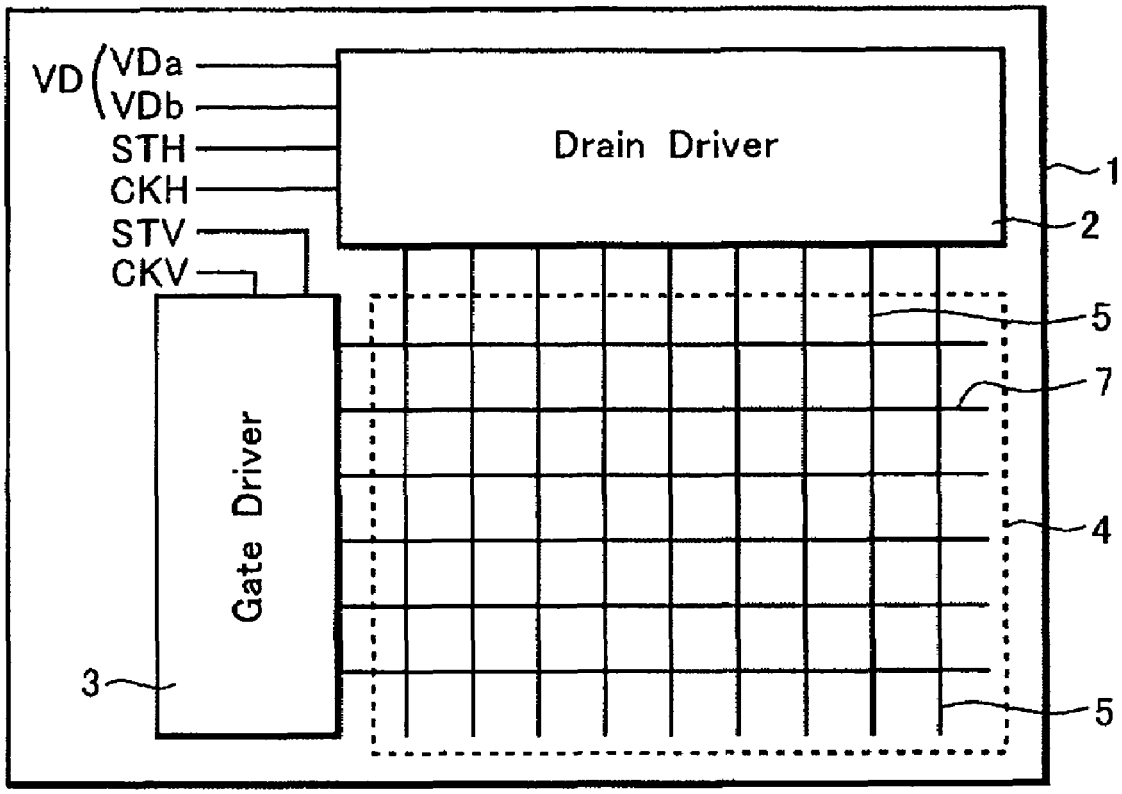
FIG. 1 is a plan view of the display panel of the active matrix display device of an embodiment of this invention.
Figure 2:
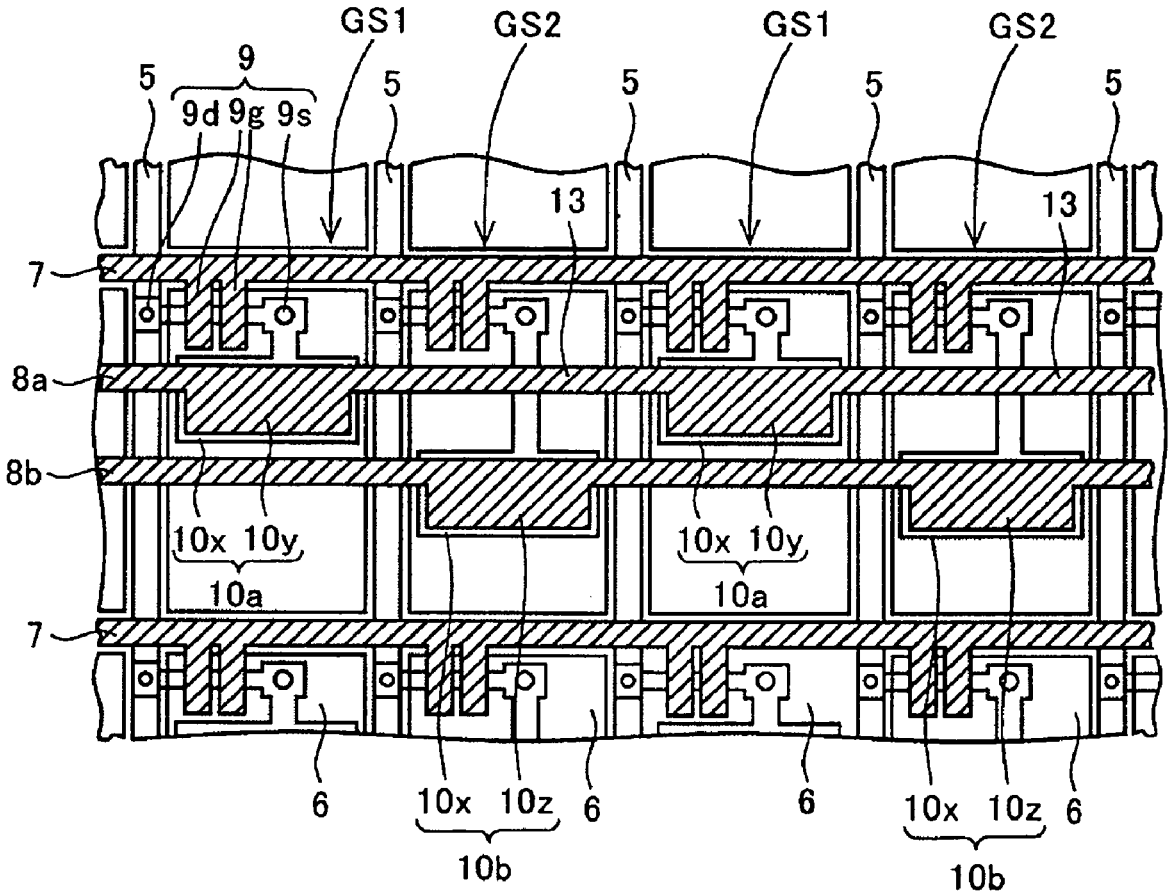
FIG. 2 is a pattern diagram of the display region in the display panel of the active matrix display device of the embodiment of this invention.

Next, an embodiment of this invention will be explained by referring to figures. FIG. 1 is a plan view of the display panel of the active matrix display device of this invention. FIG. 2 is a pattern diagram of the display region of the display panel of the active matrix display device of this invention. And FIG. 3 is an equivalent circuit diagram.

A drain driver 2 is disposed in row direction and a gate driver 3 is disposed in column direction on a display panel as shown 1 in FIG. 1. A display region 4 for displaying image is formed surrounded with the drain driver 2 and gate driver 3.

Figure 3:
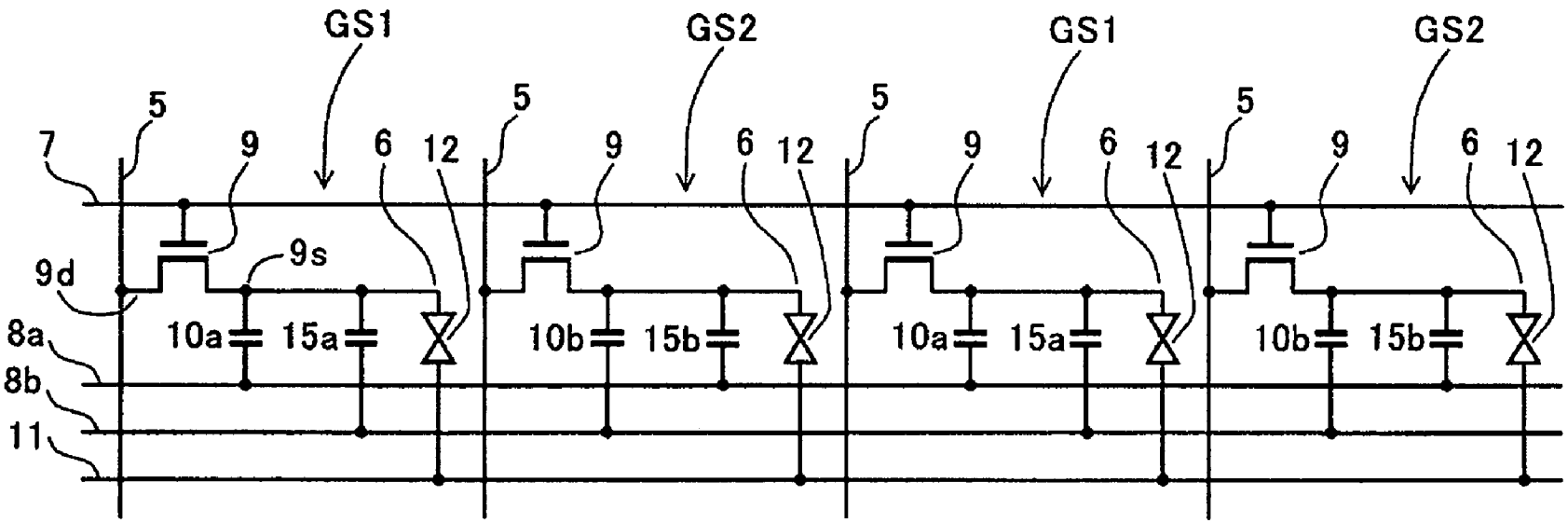
FIG. 3 is an equivalent circuit diagram of the display region shown in FIG. 2.

A plurality of drain lines 5 and a plurality of rectangular pixel electrodes 6 with the longitudinal side in the column direction are disposed in column direction and a gate line 7, a first supplemental capacitance line 8*a* and a second supplemental capacitance line 8*b* are disposed in row direction in the display region 4, as shown in FIGS. 2 and 3. A TFT 9 and either one of a first supplemental capacitance 10*a* or a second supplemental capacitance 10*b* are disposed in the region with the pixel electrode 6 (referred to as "a pixel" hereinafter). That is, the first supplemental capacitance 10*a* is disposed in the first pixel GS1 and the second supplemental capacitance 10*b* is disposed in the second pixel GS2 adjacent to the first pixel GS1. The first pixel GS1 and the second pixel GS2 are alternatively formed in row direction.

The TFT 9 includes a gate electrode 9*g* extending from the gate line 7, a drain region 9*d* that is a semiconductor layer electrically connected to the drain line 5 through a contact, and a source region 9*s* that is a semiconductor layer electrically connected to the pixel electrode 6 through a contact. The first supplemental capacitance 10*a* includes a supplemental capacitance electrode 10*x* that is a semiconductor layer connected to the TFT 9 and a supplemental capacitance electrode 10*y* extending from the first supplemental capacitance line 8*a* and superimposing over the supplemental capacitance electrode 10*x* with a capacitance-insulating layer between them. The second supplemental capacitance 10*b* includes the supplemental capacitance electrode 10*x* mentioned above and a supplemental capacitance electrode 10*z* extending from the second supplemental capacitance line 8*b* and superimposing over the supplemental capacitance electrode 10*x* with a capacitance-insulating layer between them.

A first parasitic capacitance 15*a* is formed between the pixel electrode 6 and the second supplemental capacitance line 8*b* in the first pixel GS1, and a second parasitic capacitance 15*b* is formed between the pixel electrode 6 and the first supplemental capacitance line 8*a* in the second pixel GS2.

A liquid crystal is sealed in between the first substrate with the TFT 9 and the other substrate facing the first substrate. A common electrode 11 is formed on the substrate that does not have the TFT 9, operating as a capacitance electrode corresponding to the pixel electrode 6 of a liquid crystal capacitance 12. A first video signal voltage VDa or a second video signal voltage VDb that have the polarities opposite from each other against the potential Vcom of the common electrode 11 are inputted to the drain driver 2 as shown in FIG. 1, and the drain driver 2 applied the first video signal voltage VDa or the second video signal voltage VDb to the drain line 5 consecutively selected.

The gate driver 3 consecutively selects the gate line 7 and applies a gate signal GV. The display region 4 is a region for image display with a plurality of pixel electrodes 6. The drain line 5 is the wiring for transmitting either the first video signal voltage VDa or the second video signal voltage VDb that have the polarities opposite from each other to the TFT 9 through a contact. The pixel electrode 6, which is a display unit of the pixel region, is the electrode for driving the liquid crystal together with the common electrode 11 by the video signal voltage VD transmitted from the drain line 5 through TFT 9.

The gate line 7 selected by the gate driver 3 receives the gate signal GV, turning the TFT 9 on. The first supplemental capacitance line 8*a* is formed together with the supplemental capacitance electrode 10*y* arranged in row direction in the same layer as the layer of the gate line 7, connecting the first supplemental capacitance 10*a* formed in each row. The second supplemental capacitance line 8*b* is formed together with the supplemental capacitance electrode 10*z* arranged in row direction in the same layer as the layer of the gate line 7, connecting the second supplemental capacitance 10*b* formed in each row. The first supplemental capacitance line 8*a* receives the first supplemental capacitance voltage and the second supplemental capacitance line 8*b* receives the second supplemental capacitance voltage with the polarity opposite from that of the first supplemental capacitance voltage. The polarity of the first and the second supplemental capacitance voltages is inverted with a certain circle, as it will be mentioned later.

The TFT 9 is a switching element in which the electric current go through a channel region, a semiconductor layer located directly under the gate electrode 9*g*, either from the source region 9*s* to the drain region 9*d* or from the drain region 9*d* to the source region 9*s* only when the voltage is applied to the gate electrode 9*g*. The first supplemental capacitance 10*a* and the second supplemental capacitance 10*b* holds the electric charge coming from the video signal voltage VD supplied from the drain line 5 through the TFT 9 for one frame period, supplementing the loss of electric charge by the liquid crystal capacitance 12. The common electrode 11, with a certain amount of voltage applied, drives the liquid crystal with the pixel electrode 6 according to the video signal voltage VD applied to the pixel electrode 6. The electric charge of the liquid crystal capacitance 12 comes from the video signal voltage VD supplied from the drain line 5 through the TFT 9 and held by the liquid crystal.

However, the electric charge held by the liquid crystal 12 leaks easily due to the leakage current while the TFT 9 is off because of current leakage due to the impurity in the liquid crystal. The electric charge of the liquid crystal capacitance 12 is supplemented with the electric charge held in the first supplemental capacitance 10*a* and the second supplemental capacitance 10*b*.

Figure 4:
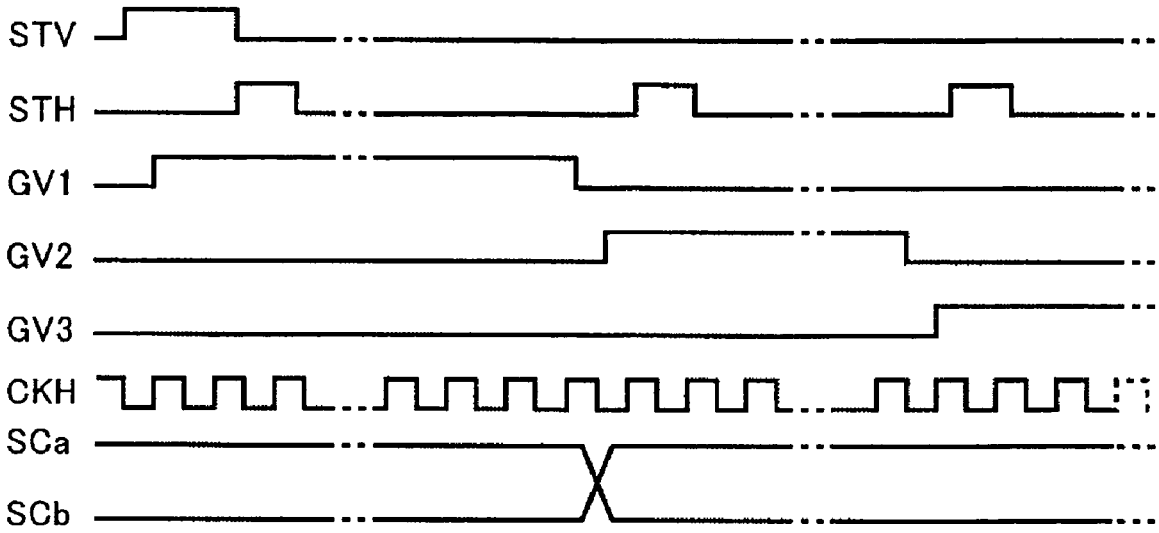
FIG. 4 is a timing chart showing the relation among the signals of the display panel of the active matrix display device of the embodiment of this invention.

Next, the driving method will be explained. FIG. 4 is a timing chart showing the relation among signals in the display panel. The chart shows the change of a vertical start signal STV, a gate signal GV, a horizontal start signal STH, a horizontal clock signal CKH, a potential SCa of the first supplemental capacitance line 8*a* and a potential SCb of the second supplemental capacitance line 8*b*.

First, the pulse of the gate signal GV1 gets started after the pulse of the vertical start signal STV becomes high level, turning on the TFT 9 connected to the gate line 7 in the first row which receives the gate signal GV1. Then, the pulse of the horizontal start signal STH becomes high level, and it is synchronized with the pulse of the horizontal clock signal CKH while the gate signal GV1 is supplied to the gate line 7 in the first row. The drain line 5 is consecutively selected and the video signal voltage VD is consecutively applied to the pixel electrode 6, the first supplemental capacitance 10*a*, and the second supplemental capacitance 10*b* through the TFT 9.

The first video signal voltage VDa is fed to the pixel electrode 6 of the first pixel GS1, the first supplemental capacitance 10*a* and the first parasitic capacitance 15*a*, and the second video signal voltage VDb is fed to the pixel electrode 6 of the second pixel GS2, the second supplemental capacitance 10*b* and the first parasitic capacitance 15*b*. The gate signal GV1 stops being supplied to the gate line 7 on the first row, turning off the TFT 9 connected to the gate line 7 when the video signal voltage VD is fed to all the drain lines 5. Then, the pulse of the gate signal GV2 and gate signal GV3 consecutively starts up, feeding the gate signal GV2 to the gate line 7 on the second row and the gate signal GV3 to the gate line 7 on the third row. This operation is repeated. The polarity of the potential SCa of the first supplemental capacitance line 8*a* and the potential SCb of the second supplemental capacitance line 8*b* are inverted while the TFT 9 connected to the gate line 7 is off because the gate line 7 does not receive the gate signal GV. That is, the polarity is inverted for the duration staring from the time when the gate signal GV1 drops down and till the time when the gate signal GV 2 becomes high level. The inversion of the polarity between the potential SCa of the first supplemental capacitance line 8*a* and the potential SCb of the second supplemental capacitance line 8*b* takes place for each row for each frame circle.

Figure 5A:
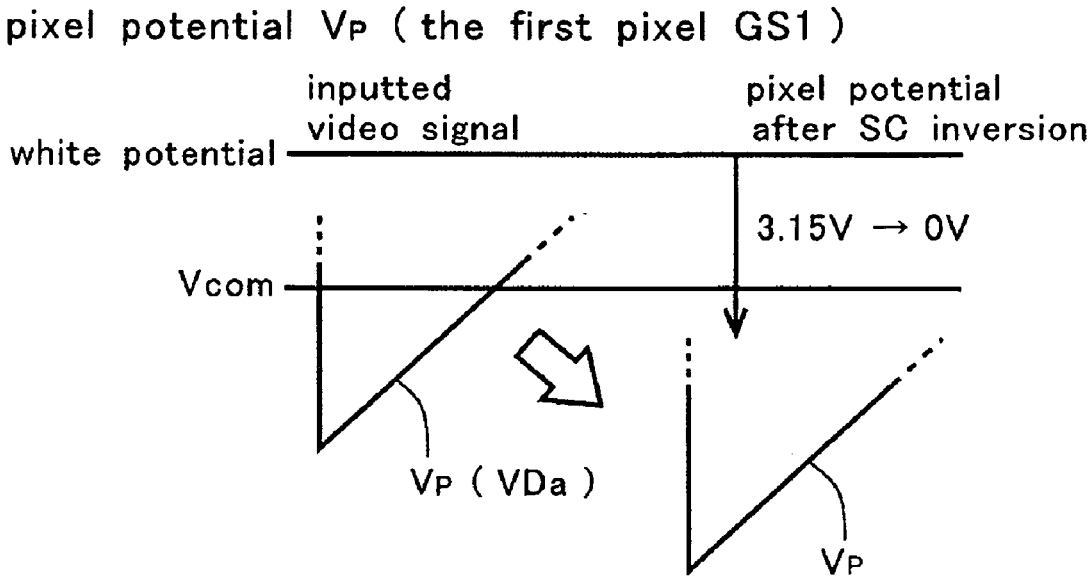
FIGS. 5A and 5B are waveforms of the signal showing the driving method of the active matrix display device of the embodiment of this invention.
Figure 5B:
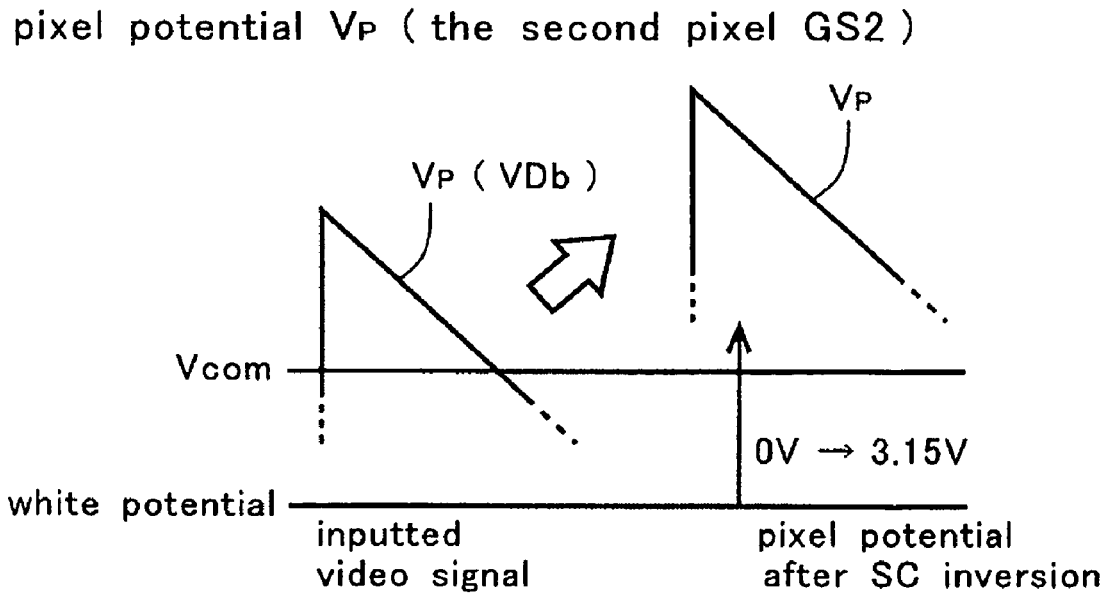

The potential of the pixel electrode 6 (refereed to as the pixel potential Vp, hereinafter) changes either to the positive potential direction or the negative potential direction through the capacitance coupling of the pixel electrode 6 with the first supplemental capacitance 10*a* and first parasitic capacitance 15 *a* or the capacitance coupling with the second supplemental capacitance 10*b* and the second parasitic capacitance 15*b*, performing the dot inversion driving, based on the potential change ΔVs of the supplemental capacitance line. Then, the pulse of the vertical start signal STV starts up again when the gate signal GV is fed to all the gate line 7, feeding the gate signal GV to the gate line 7 on the first row. The same operation is repeated. FIGS. 5A and 5B are the waveform showing the driving method of the display device of an embodiment of this embodiment. FIG. 5A shows the change of the pixel potential Vp of the first pixel GS1 around the time when the polarity of the potential SCa of the first supplemental capacitance line 8*a* is inverted. FIG. 5B shows the change of the pixel potential Vp of the second pixel GS2 around the time when the polarity of the potential SCb of the second supplemental capacitance line 8*b* is inverted.

It shows that the potential SCa of the first supplemental capacitance line 8*a* is inverted from 3.15V to 0V and the potential SCb of the second supplemental capacitance line 8*b* is inverted from 0V to 3.15V after the gate signal GV1 becomes low level. The pixel potential Vp of the first pixel GS1 changes in negative voltage direction against the stable potential Vcom of the common electrode 11 and the pixel potential Vp of the second pixel electrode GS2 changes in positive voltage direction against the stable potential Vcom of the common electrode 11 through the capacitance coupling mentioned above according to the potential change ΔVsc.

The display device of this embodiment performs the dot inversion driving for eliminating the effect of the video signal voltages adjacent to each other, preventing the irregularity of the image due to the capacitance coupling. Additionally, the display device can make the dynamic range of the inputted video signal voltage narrower by feeding either the first or the second supplemental capacitance voltage to the first and the second supplemental capacitance lines 8*a* and 8*b* while the switching element is off, leading to the lower energy consumption.

Next, the correction of the signal level of the first and the second video signal voltages VDa and VDb will be explained in detail. The pixel potential Vp after the change due to the inversion between the polarities of the potential SCa of the first supplemental capacitance line 8*a* and the potential SCb of the second supplemental capacitance line 8*b* can be expressed as follows:

$$Vp=VD\pm(Csc-Cpa)\times\Delta Vsc/\mathrm{Call} \quad (1)$$

$$\mathrm{Call}=Clc+Csc+Cpa+Cgs \quad (2)$$

where VD is either the first video signal voltage VDa or the second video signal voltage VDb, Csc is the capacitance value of either the first supplemental capacitance 10*a* or the second supplemental capacitance 10*b*, Cpa is the capacitance value of either the first parasitic capacitance 15*a* or the second parasitic capacitance 15*b*, Clc is the capacitance value of the liquid crystal 12, Cgs is the parasitic capacitance between the gate and the source of the TFT 9, Call is the total capacitance value, and ΔVsc is the potential change of either the potential SCa of the first supplemental capacitance line 8*a* or the potential SCb of the second supplemental capacitance line 8*b* upon the inversion.

The pixel potential Vp depends on the capacitance value Cls of the liquid crystal capacitance 12 because Call in the second part of the first equation (1) includes the capacitance value Clc of the liquid crystal capacitance 12. However, the pixel potential Vp takes a non-linear change against the video signal voltage VD because the dielectric constant of the liquid crystal changes depending on the applied voltage, that is, the potential difference between the pixel potential Vp and the potential Vcom of the common electrode 11. Therefore, without the correction schemes described below, the pixel potential adequate to the video signal voltage VD cannot be obtained, deteriorating the gradation characteristics.

Figure 6:
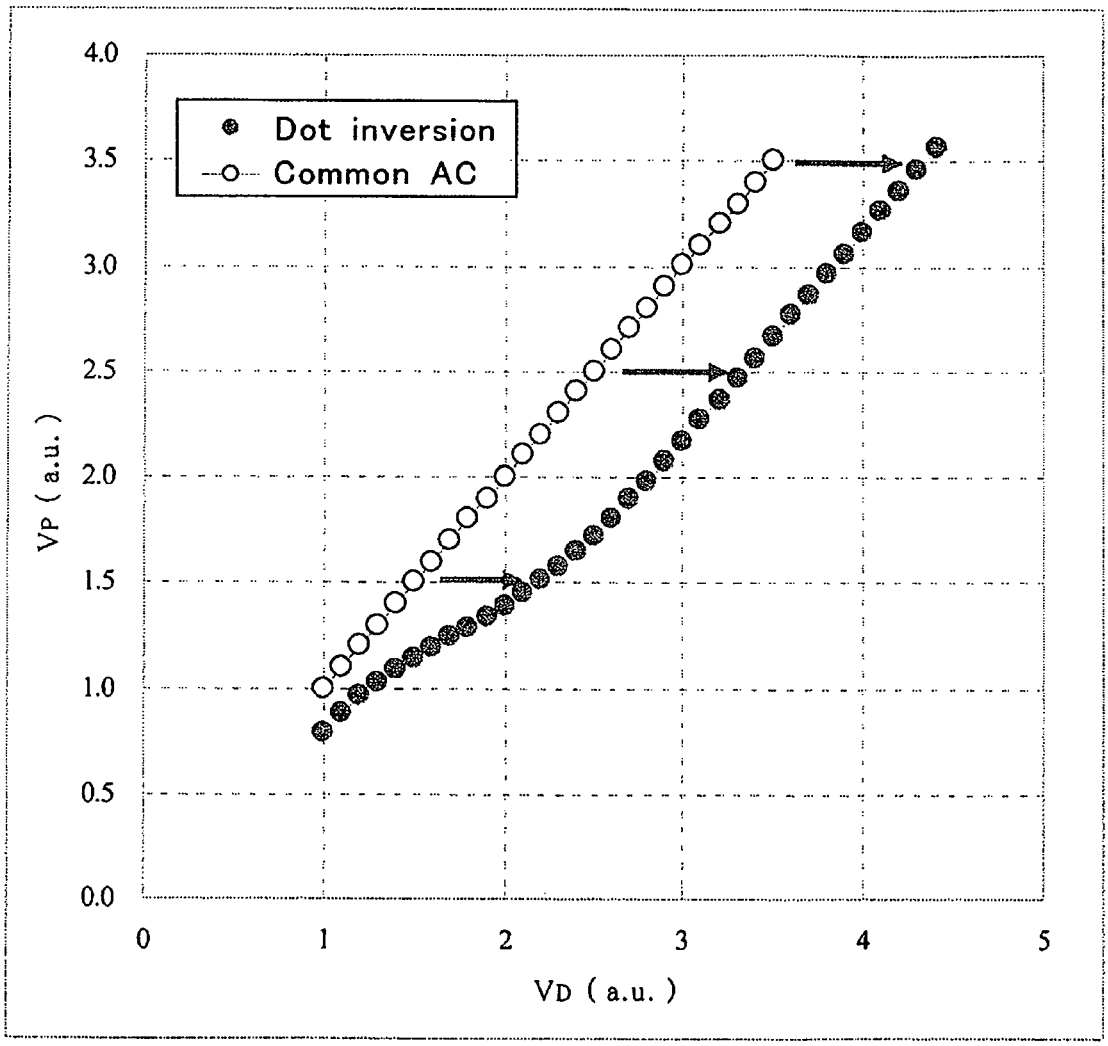
FIG. 6 shows the relation between the video signal voltage and the pixel voltage of the embodiment.

FIG. 6 shows the relation between the video signal voltage VD (the first video signal voltage VDa and the second video signal voltage VDb) and the pixel potential Vp. The x-axis corresponds to the video signal voltage VD (more specifically, the video signal voltage with the potential Vcom of the common electrode 11 as the reference voltage) and the y-axis corresponds to the pixel potential Vp. The pixel potential Vp changes linearly with the common AC driving but the pixel potential Vp changes non-linearly with the dot inversion driving of this embodiment, as seen from the figure.

The reason why the potential changes non-linearly will be explained by using the case of TN liquid crystal as an example. The dielectric constant of a TN liquid crystal becomes small when the applied voltage becomes small, and it becomes large when the applied voltage becomes large. Therefore, the influence of the capacitance value Clc of the liquid crystal capacitance 12 to the total capacitance value Call in the equation (2) becomes larger as the video signal voltage VD gets larger. Thus, the pixel potential Vp of the equation (1) changes non-linearly against the video signal voltage VD as shown in FIG. 6. This non-linear change takes place not only in TN liquid crystal, but it also occurs in other kinds of liquid crystal.

Therefore, the display device of this embodiment has a correction scheme correcting the first and the second video signal voltages VDa and VDb for eliminating the effect of the dependency of the dielectric constant of the liquid crystal to the pixel potential Vp.

Figure 7:
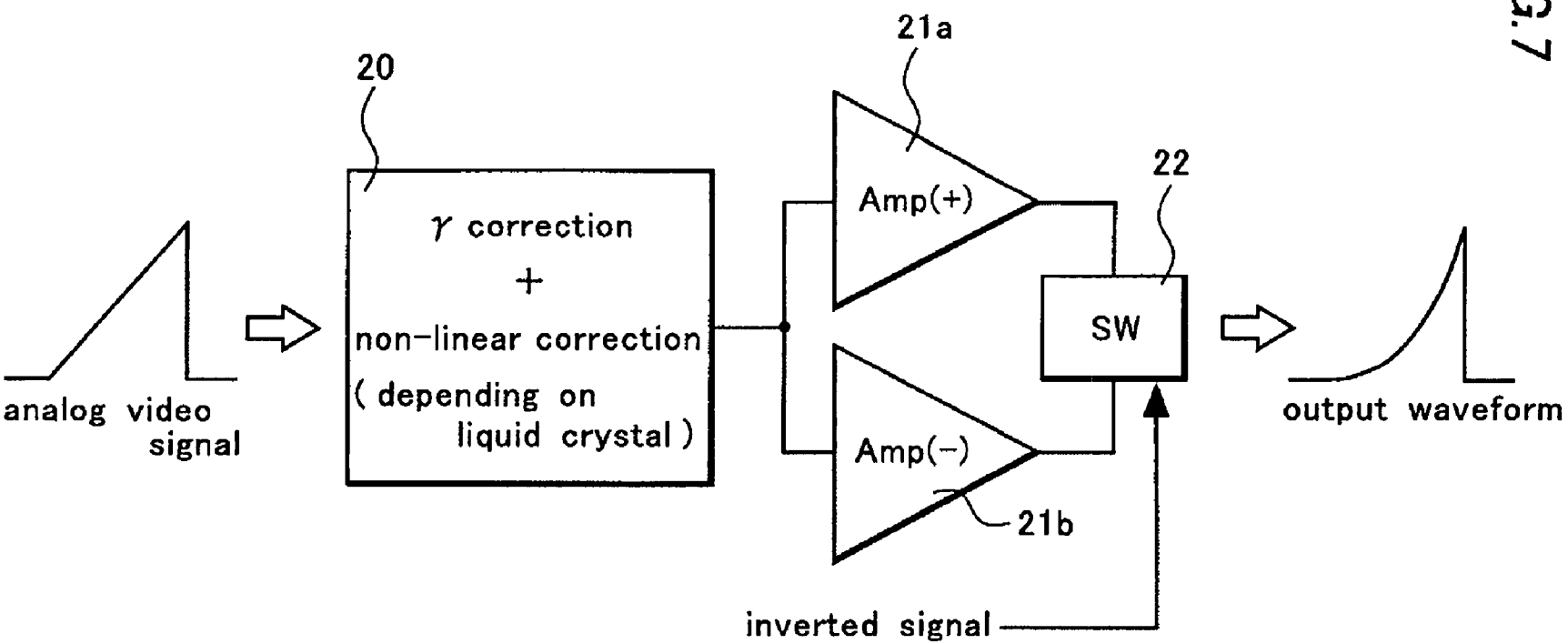
FIG. 7 is a block diagram showing the correction method of the video signal of the active matrix display device of the embodiment of this invention.

Next, examples of the correction scheme will be explained by referring to the figures. FIG. 7 is the circuit diagram of a correction circuit when the inputted video signal is an analog video signal. A non-linear amplifier 20 performs a gamma correction to the analog video signal inputted from outside along with the non-linear correction for eliminating the effect of the dependency of the dielectric constant of the liquid crystal to the pixel potential Vp. The analog video signal corrected by the non-linear amplifier 20 is then applied to a pair of amplifiers 21*a* and 21*b* that output a pair of signals with the polarity inverted against the potential Vcom of the common electrode 11. A switching circuit 22 switches and outputs the output from the pair of the amplifiers 21*a* and 21*b* according to an inverted signal. The signal from the switching circuit 22 corresponds to either the first video signal voltage VDa or the second video signal voltage VDb.

Figure 8:
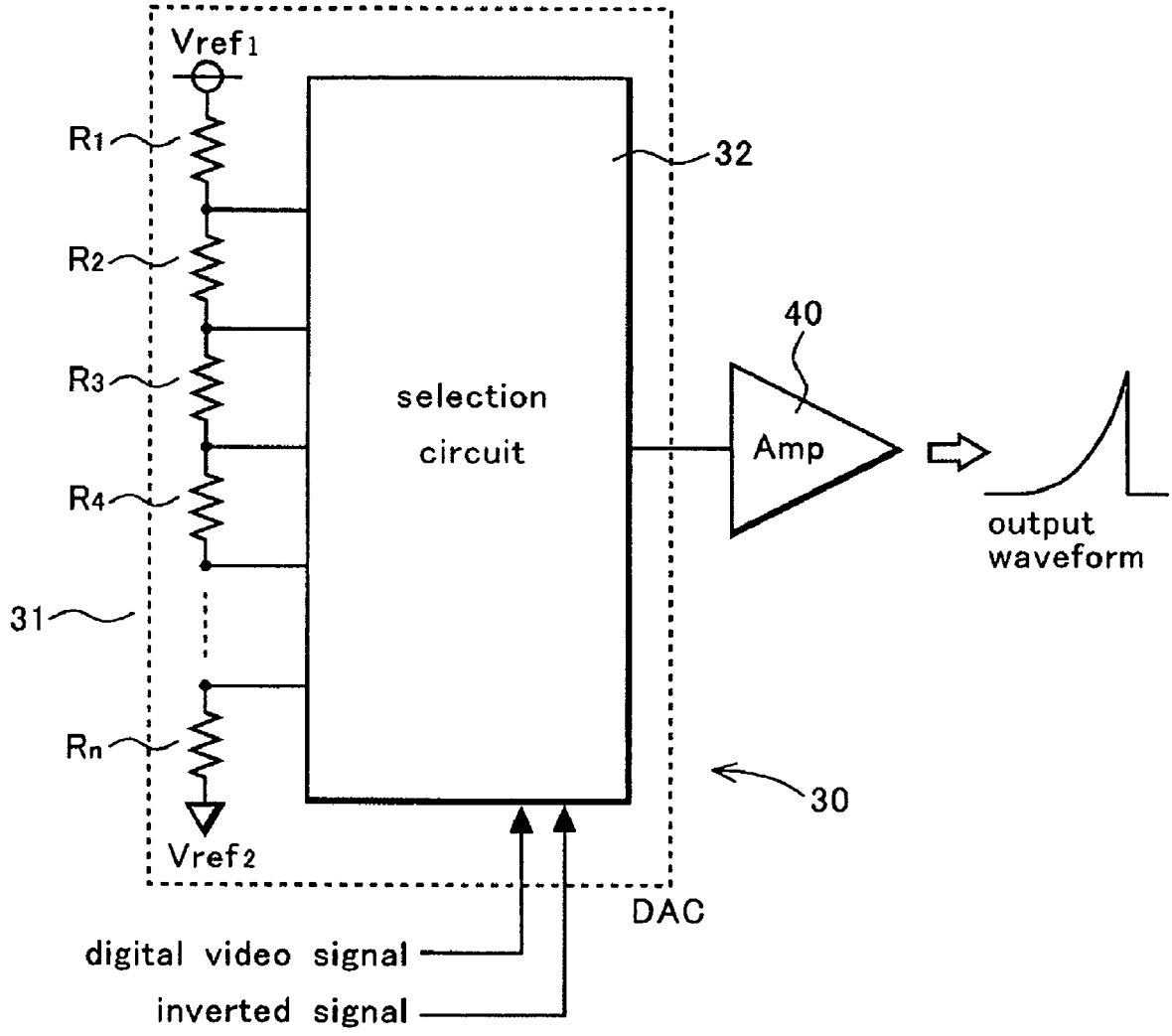
FIG. 8 is a block diagram showing the correction method of the video signal of the active matrix display device of the embodiment of this invention.

FIG. 8 is the circuit diagram of a correction circuit when the inputted video signal is a digital video signal. The numeral 30 indicates a digital analog converter (DAC). It has a divider resistor 31 configured from a plurality of resistors in series R1, R2, - - - Rn with reference voltages Vref1 and Vref2 applied to both ends and a voltage selection circuit 32 for selecting and outputting the voltage of the connection point of each resistor of resistors in series R1, R2, - - - Rn.

Each resistor value of the resistors in series R1, R2, - - - Rn is adjusted to receive the gamma correction and non-linear correction for eliminating the effect of the dependency of the dielectric constant of the liquid crystal to the pixel potential Vp based on the digital video signal. Also, the digital analog converter 30 has a function for inverting the polarity of an output signal by inverting the polarity of the reference voltages Vref1 and Vref2 based on an inversion signal. The output of the digital analog converter 30 is outputted through the amplifier 40. The output signal of the amplifier 40 corresponds to either the first video signal voltage VDa or the second video signal voltage VDb.

Figure 9:
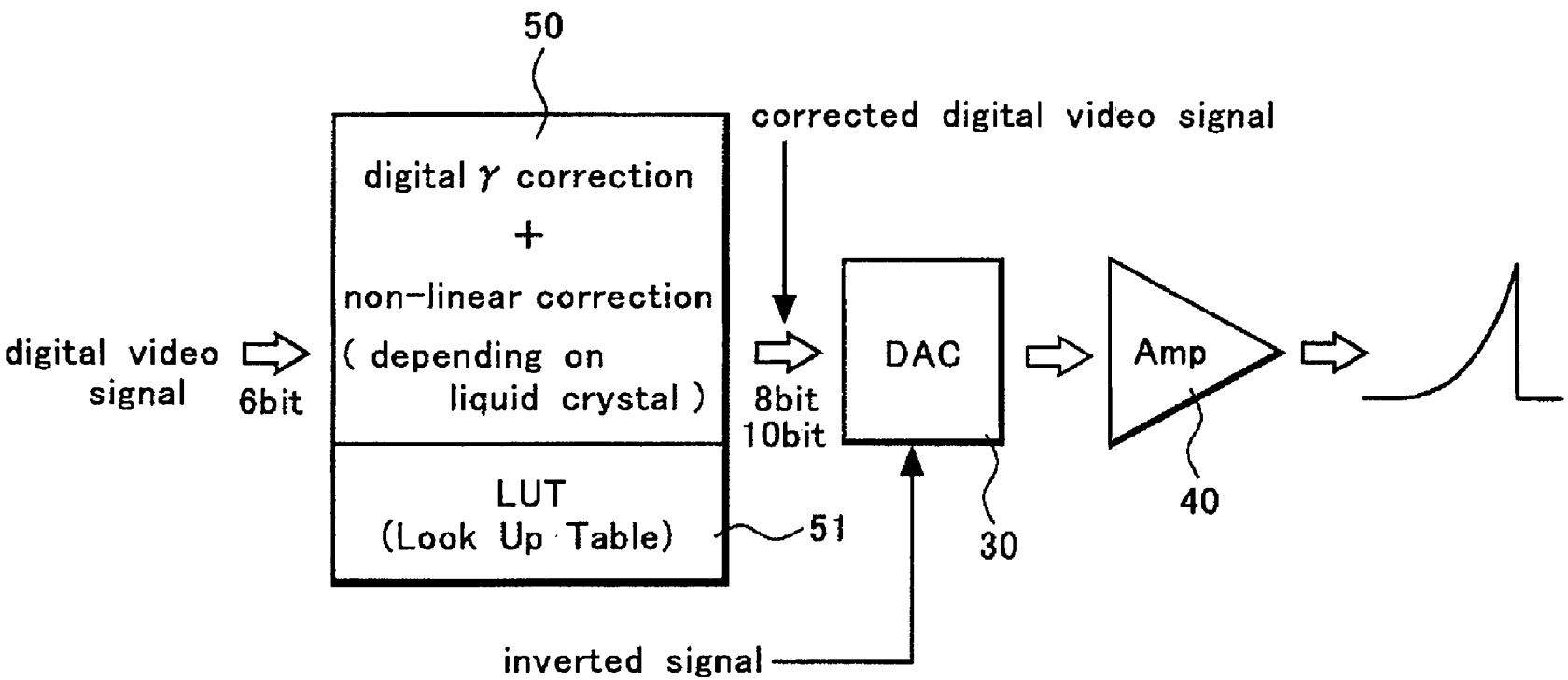
FIG. 9 is a block diagram showing the correction method of the video signal of the active matrix display device of the embodiment of this invention.

FIG. 9 is the circuit diagram of another correction scheme when the inputted video signal is a digital video signal. For example, a 6-bit digital video signal is inputted to a digital correction circuit 50. The digital correction circuit 50 digitally corrects the digital video signal by referring to the digital video signal and a look-up table 51 with a corrected value corresponding to the digital video signal.

Here, the value corrected by the look-up table 51 is the corrected value for eliminating the effect of the dependency of the dielectric constant of the liquid crystal to the pixel potential Vp. The digital correction circuit 50 expands the 6-bit digital video signal into 8-bit or 10-bit digital video signal upon the correction in order to acquire better precision. Additionally the digital correction circuit 50 performs the gamma correction to the digital video signal. The digital video signal corrected by the digital correction circuit 50 is then converted into analog video signal by the digital analog converter 30 and amplified by the amplifier 40. The output signal of the amplifier 40 corresponds to either the first video signal voltage VDa or the second video signal voltage VDb.

Figure 10:
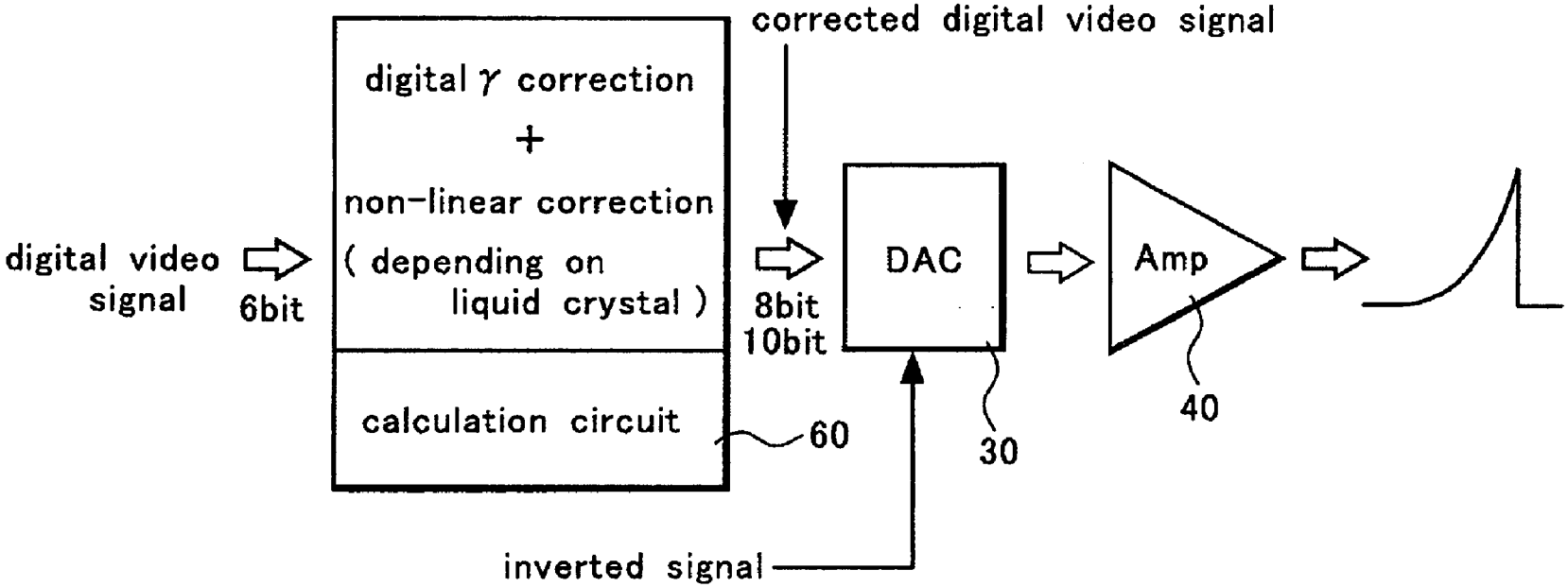
FIG. 10 is a block diagram showing the correction method of the video signal of the active matrix display device of the embodiment of this invention.
Figure 11:
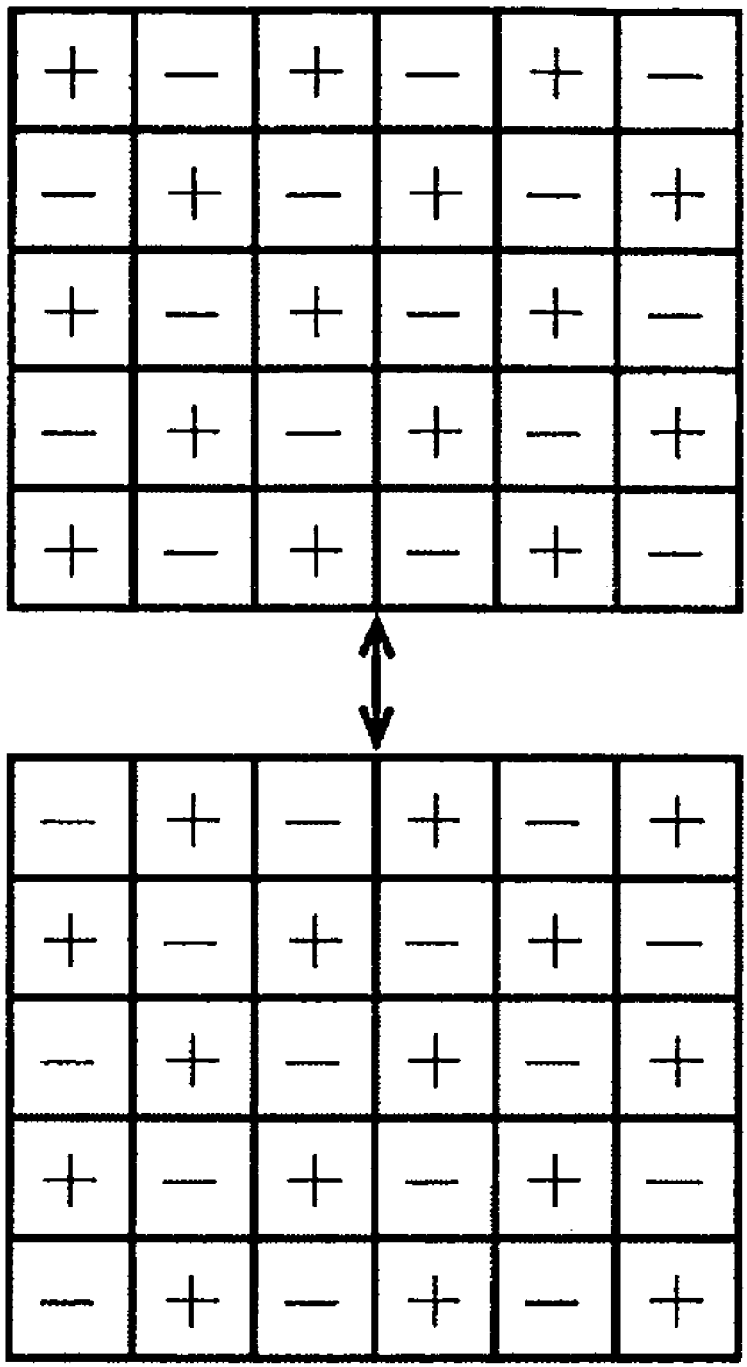
FIG. 11 PRIOR ART
FIG. 11 is a diagram showing the dot inversion driving method of a conventional active matrix display device.

FIG. 10 is the circuit diagram of yet another correction scheme when the inputted video signal is also a digital video signal. The correction using the look-up table 51 is not performed in this correction means. A digital calculation circuit 60 expands the bit data of the digital video signal and performs the gamma correction as well as the correction for eliminating the effect of the dependency of the dielectric constant of the liquid crystal to the pixel potential Vp. The digital video signal corrected by the digital calculation circuit 60 is then converted into analog video signal by the digital analog converter 30 and amplified by the amplifier 40. The output signal of the amplifier 40 corresponds to either the first video signal voltage VDa or the second video signal voltage VDb.

The correction means shown in FIGS. 7-10 can be formed either in the display panel or in the LSI outside of the display panel.

What is claimed is:

1. An active matrix display device comprising:

a plurality of pixel electrodes disposed on a substrate in a matrix configuration;

a liquid crystal sealed between the pixel electrodes and a common electrode;

a plurality of switching elements connected to corresponding pixel electrodes;

a first supplemental capacitance line supplied with a first potential;

a second supplemental capacitance line supplied with a second potential, the first and second potentials alternating with a first cycle;

a supplemental capacitance electrode provided for each of the pixel electrodes so that each supplemental capacitance electrode forms a capacitance between said each supplemental capacitance electrode and the first supplemental capacitance line or the second supplemental capacitance line;

a driver circuit supplying to the pixel electrodes and the supplemental capacitance electrodes through the switching elements a first video signal and a second video signal that are opposite in polarity and alternate in a second cycle; and a correction circuit correcting the first and second video signals so as to reduce an effect of a dielectric constant of the liquid crystal that changes in response to a change in a potential applied to the liquid crystal on potentials of the pixel electrodes receiving the first video signal or the second vide signal.

2. The active matrix display device of claim 1, wherein the correction circuit comprises a non-linear amplifier correcting an analog video signal that the correction circuit receives.

3. The active matrix display device of claim 1, wherein the correction circuit comprises a divider resistor receiving reference voltages at both ends thereof and a voltage selection circuit selecting a voltage of a connection point of the divider resistor according to an digital video signal the correction circuit receives.

4. The active matrix display device of claim 1, wherein the correction circuit comprises a circuit that digitally corrects a digital video signal that the correction circuit receives based on the digital video signal and a look-up table for correcting the digital video signal.

5. The active matrix display device of claim 1, wherein the correction circuit comprises a digital calculation circuit that digitally corrects a digital video signal the correction circuit receives.

6. The active matrix display device of claim 1, wherein the potential of the common electrode is a DC voltage.

7. The active matrix display device of claim 1, wherein the display is configured so that the polarity of the first and second video signals is inverted for each frame period.

8. The active matrix display device of claim 1, wherein the display is configured so that the first and the second potentials change while the switching elements are off.

9. The active matrix display device of claim 1, wherein the display is configured so that the first and the second potentials change for each frame period.

* * * * *